US006863319B1

(12) United States Patent
Bentley

(10) Patent No.: US 6,863,319 B1
(45) Date of Patent: Mar. 8, 2005

(54) SECURITY DOOR LOCK

(76) Inventor: James K. Bentley, 2405 Cowper St., Cambria, CA (US) 93248

( * ) Notice: Subject to any disclaimer, the term of this patent is extended or adjusted under 35 U.S.C. 154(b) by 0 days.

(21) Appl. No.: 10/350,677

(22) Filed: Jan. 27, 2003

(51) Int. Cl.[7] ..... E05C 17/04

(52) U.S. Cl. ..... 292/262; 292/253; 292/288; 292/289

(58) Field of Search ..... 292/1, 262, 288, 292/289, 338, 339, 253, DIG. 2

(56) References Cited

U.S. PATENT DOCUMENTS 3,313,566 A * 4/1967 Sipes ..... 292/292
3,804,454 A * 4/1974 Simmons ..... 292/262
3,809,417 A * 5/1974 Craig ..... 292/259 R
4,155,578 A * 5/1979 Rolland ..... 292/292
4,281,865 A * 8/1981 Nicholson ..... 292/258
4,288,119 A * 9/1981 Geiger ..... 292/262
4,478,442 A * 10/1984 Martin ..... 292/248
4,629,229 A * 12/1986 Correnti et al. ..... 292/246
4,790,581 A * 12/1988 Boswell et al. ..... 292/264
4,917,422 A * 4/1990 Rose ..... 292/293
5,465,595 A * 11/1995 Sheppard ..... 70/416
5,716,084 A * 2/1998 Sanford et al. ..... 292/264
5,908,213 A * 6/1999 Tippetts et al. ..... 292/246

* cited by examiner

*Primary Examiner*—Robert J. Sandy
*Assistant Examiner*—Thomas Ho
(74) *Attorney, Agent, or Firm*—Charles C. Logan, II

(57) ABSTRACT

A security door lock that is secured by two lag bolts to the vertical wall studs forming a doorway frame. The security door lock is installed directly opposite a doorknob on the door and it has a vertically oriented base plate having at least one vertically oriented groove. A pair of cable tensioning sliders are reciprocally mounted in the vertically oriented groove. A cable has its opposite ends secured to the base plate and the cable passes around the respective cable tensioning sliders. A spring connected between the respective cable tensioning sliders keep them biased away from each other when the cable has not been looped over the doorknob. A cover plate is detachably secured to the base plate and a chamber is formed therebetween into which the cable returns when it is not being used.

14 Claims, 2 Drawing Sheets

SECURITY DOOR LOCK

BACKGROUND OF THE INVENTION

The invention relates to a security lock, and more specifically a security door lock that prevents forced entry through a door of a residence by incorporating the strength of the doorway frame into the security door lock assembly.

Presently it is a problem in apartments and other residences to prevent forced entry therein when an entry door is partially opened in response to a knocking thereon or a person's voice. It is common practice in many residences to have a security lock utilizing a chain which has slider member attached to its front end that is quickly and easily slid into a bracket mounted on the rear surface of the door. The other end of the chain is attached by a bracket securing it to the inside surface of the wall inside the doorway. This device offers very little security to the occupant of the residency if a stranger applies a forceful kick or powerful body force against the front surface of the door when it is partially open. The bracket structure on the inner surface of the door engaging the slider on the end of the chain will normally be pulled from its mounting thereby allowing access into the residence.

It is an object of the invention to provide a novel security door lock that can prevent an intruder from entering a person's residency after they have partially opened their door.

It is also an object of the invention to provide a novel security door lock that incorporates the structural integrity of the entire doorway frame to prevent an intruder from forcefully ripping the security lock from either the inside of the door or the inside wall adjacent the doorway frame.

It is another object of the invention to provide a novel security door lock that can be quickly and easily installed.

It is a further object of the invention to provide a novel security door lock that is economical; to manufacture and market.

SUMMARY OF THE INVENTION

The security door lock is mounted on the inner wall adjacent a doorway frame at a position opposite the doorknob. It is secured to the wall studs forming the doorway frame by two lag bolts.

The major components of the security door lock are the base plate, the cover plate, a nylon-coated steel security cable, a pair of cable tensioning sliders, a spring and a pair of lag bolts. The base plate has a spacer bar and a pair of spacer posts extending from its rear surface. Each spacer post has an aperture through which a lag bolt is inserted and screwed into the studs of the doorway frame. A pair of vertically spaced grooves are formed in the base plate for slidingly receiving a pair of vertically spaced cable tensioning sliders. The cable tensioning sliders travel reciprocally upwardly and downwardly in their respective grooves. The nylon-coated steel security cable has its opposite ends secured to the respective lag bolts adjacent their front ends and the security cable passes around a tracking groove in the side walls of the respective cable tensioning sliders and also passes around a cable guide. A cover plate is removably slid over the front of the base plate and it has an aperture or cutaway portion in its side wall adjacent the doorknob on the door. At this time the entire security cable is contained within the chamber formed between the base plate and the cover plate.

To engage the security cable, a thumb or finger is inserted into the aperture or cut-away portion of the side wall of the cover plate and the cable is caught. It is then pulled to and over the doorknob. As the cable is pulled, the spring is compressed (as the cable tensioning sliders come closer together). Once the cable is released over the doorknob, any remaining slack is taken up by the decompression of the spring. The door can be opened several inches when the cable is looped over the doorknob (until the cable is pulled tight against the lag bolts to which it is secured). Once this point is reached, the structural integrity of the doorway frame becomes part of the security door lock assembly.

DESCRIPTION OF THE PREFERRED EMBODIMENT

Figure 1:
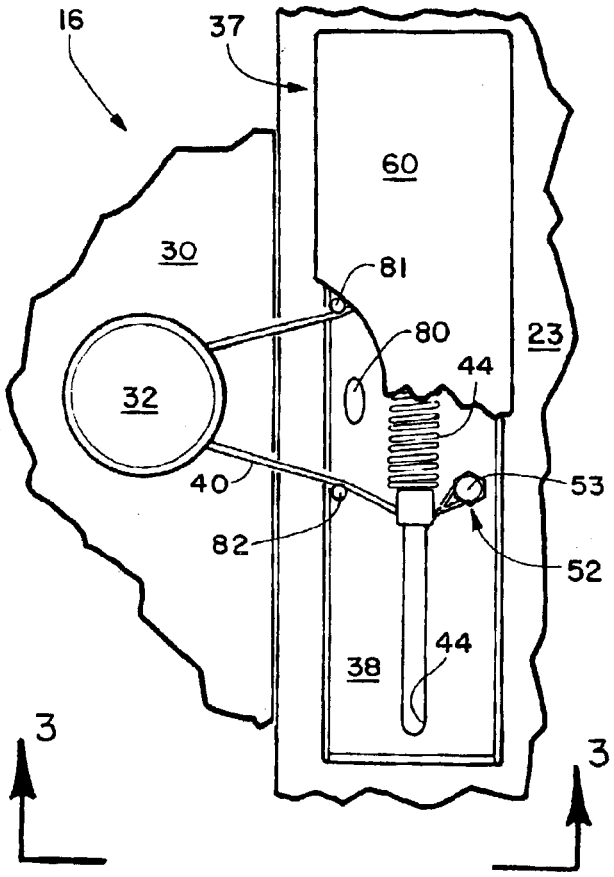
FIG. 1 is a front elevation view showing the security door lock secured to the doorway frame and the cable looped over the doorknob of the door.

The security door lock will now be described by referring to FIGS. 1–12. The security door lock is generally designated numeral 16. Security door lock 16 is attached to doorway frame 18 by lag bolts 52 as show in FIGS. 1–3.

Doorway frame 18 has a pair of vertically oriented studs 19 and 20. They are surrounded by an outer wall 22, an inner wall 23 and a doorway wall 24. Strips of molding 26 and 28 are nailed to the outer surface of the respective walls. A door 30 is illustrated having an outside doorknob 31 and an inside doorknob 32. Inside doorknob 32 has a neck portion 34.

The major components of security door lock 16 are base plate 36, cover plate 37, cable 40 cable tensioning sliders 42 and spring 44.

Base plate 36 will now be described by referring to FIGS. 1, 2, 4 and 5. Base plate 36 has a height H1 and H1 is in the range of 10–18 inches. It has a width W1 and W1 is in the range of 2–4 inches. It has a thickness T1 and T1 is in the range of 125–0.625 inches. Base plate 36 is preferably made of steel material. It has a front surface 38, a rear surface 39, a right side flange 41, a left side flange 42, and a pair of vertically oriented grooves 43 and 44. Grooves 43 and 44 could be replaced by a single groove, however this could have the effect of weakening the strength of base plate 36. A spacer bar 46 and two vertically spaced spacer posts 47 and 48 extend outwardly from rear surface 39 a distance D1 and D1 is in the range of 0.250–0.750 inches. Spacer posts 47 and 48 each have an aperture 50 that receives a lag bolt 52 for securing base plate 36 to stud 20 (see FIG. 3). Lag bolts 52 have a head 53 and a shank portion 54. Lag bolts 52 have a length L1 and L1 is in the range of 1–4 inches. Shank portion 54 is screwed well into stud 20 to provide major strength to the security door lock. A flange 56 extends forwardly from the bottom of front surface 38 and provides a stop for cover plate 37 when it is slid onto base plate 36.

Cover plate 37 will now be described by referring to FIGS. 1,6,7 and 8. Cover plate 37 has a front wall 60, a top wall 61, a left side wall 62, a right side wall 63. A groove 65 is formed on the inner surface of left side wall 62 and a groove 66 is formed on the inner surface of right side wall 63. These respective grooves engage the flanges 42 and 41 when cover 37 is slid downwardly over the front of base plate 36. An aperture or cutout portion 68 is formed in left side wall 62 and front wall 60 to give finger access to cable 40 when it is in its static position as illustrated in FIG. 2.

Figure 10:
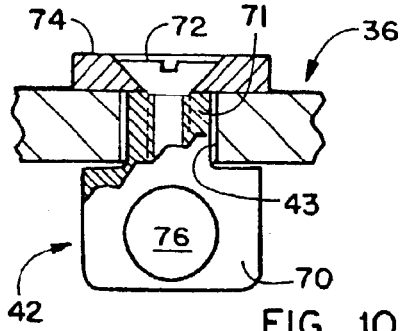
FIG. 10 is an inverted front end elevation view of the cable tensioning slider showing it installed in a groove in the base plate and having portions broken away.
Figure 11:
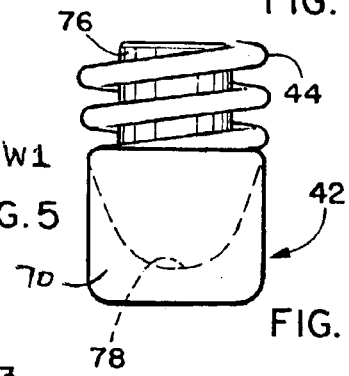
FIG. 11 is a top plan view of the cable tensioning slider showing it attached to one end of the spring.
Figure 7:
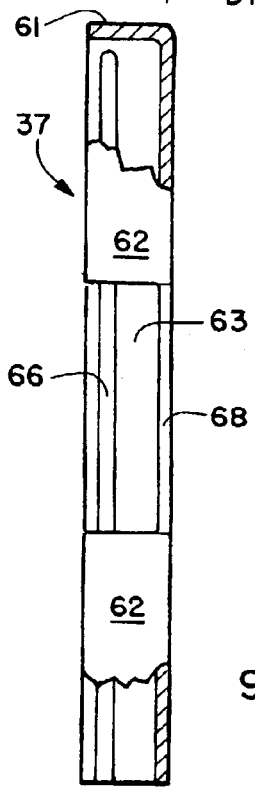
FIG. 7 is a left side elevation view of the cover plate with portions broken away.
Figure 8:
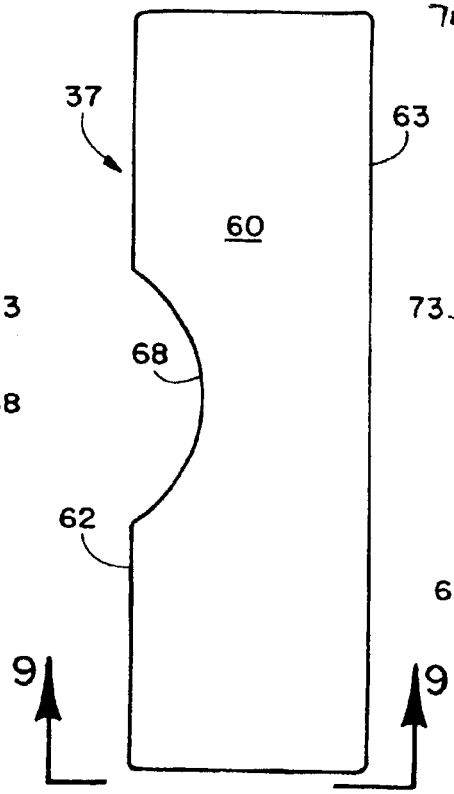
FIG. 8 is a front elevation view of the cover plate.
Figure 12:
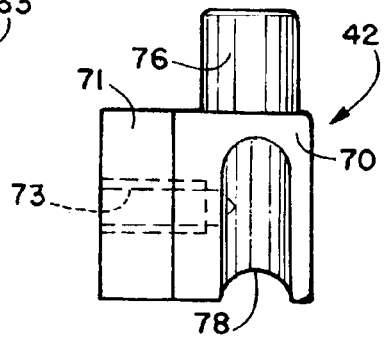
FIG. 12 is a side elevation view of the cable tensioning slider.
Figure 9:
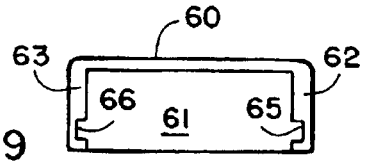
FIG. 9 is a top plan view of the cover plate.

The structure of cable tensioning sliders 42 and the manner in which they are captured in the respective grooves 43 and 44 is best understood by referring to FIGS. 10–12 of the drawings. Cable tensioning sliders 42 have a body portion 70 with a downwardly extending shank portion 71 that extends through the respective grooves 43 and 44. The bottom end of shank 71 has an internally threaded bore hole 73 for receiving a bolt 72 that secures bottom plate 74 to the bottom end of shank portion 43. The length of shank portion 71 is sufficient to allow the cable tensioning slider 42 to freely travel upwardly and downwardly in the respective grooves 43 and 44. A boss member 76 extends from body member 70 and an end of spring 44 is received there over. A groove 78 extends around a major portion of body 70 and provides a track for receiving and guiding cable 40.

Figure 2:
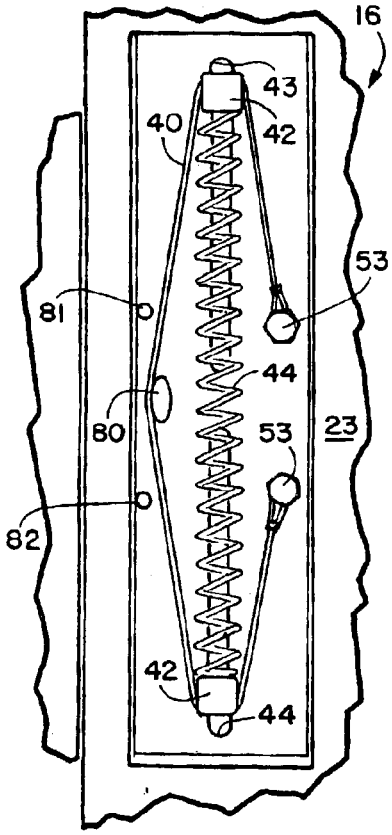
FIG. 2 is a front elevation view of the security door lock with the cover removed and the cable returned to its not in use position inside the cover plate.
Figure 3:
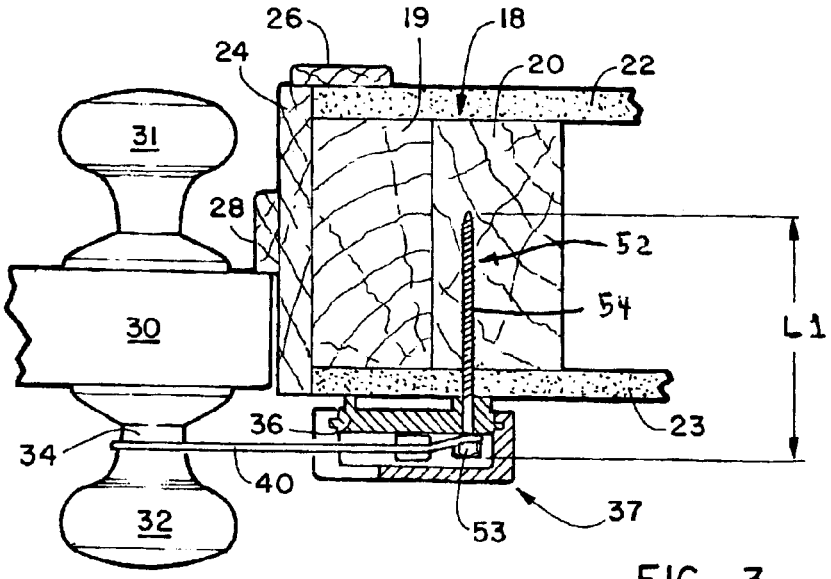
FIG. 3 is a horizontal cross sectional view taken along lines 3—3 of FIG. 1.
Figure 4:
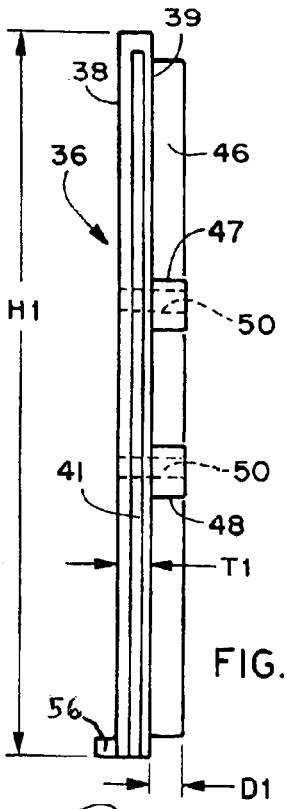
FIG. 4 is a right side elevation view of the base plate.
Figure 5:
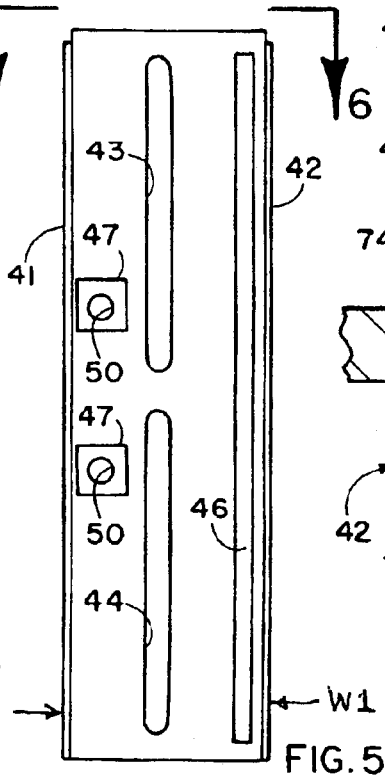
FIG. 5 is a rear elevation view of the base plate.
Figure 6:
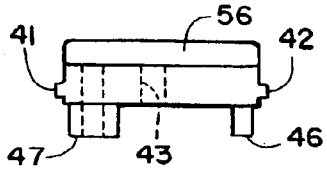
FIG. 6 is a top plan view of the base plate.

Referring to FIGS. 1 and 2 of the drawings, the operation of the security door lock will now be described. In FIG. 2, spring 44 has forced the respective cable tensioning sliders 42 to their upper and lower limits in the respective grooves 43 and 44. Cable 40 also rests against cable guide member 80. In order to install cable 40 over neck portion 34 of doorknob 32, a person has to reach one or two fingers into the aperture or cutout section 68 of cover plate 37 and grab cable 40. In FIG. 1 cable 40 is seen to travel against cable guide members 81 and 82 as it is stretched over doorknob 32.

What is claimed is:

1. A security door lock comprising:

a vertically oriented elongated base plate having a front surface, a rear surface, a left side, a right side, a top end and a bottom end; spacer means for spacing said rear surface of said base plate a predetermined distance D1 from a doorway frame to which said base plate would be secured;

means for securing said base plate to a doorway frame;

a cable having a first end, a second end and an intermediate portion;

means for securing said first and second ends of said cable to said base plate; said cable having a predetermined length L1;

a vertically oriented cover plate having a front surface, a rear surface, a left side wall, a right side wall, and an aperture formed in said left side wall through which said intermediate portion of said cable can be accessed and pulled outwardly therefrom so it can be looped over a door knob; and means for removably securing said cover plate to said base plate to form a chamber between ad front surface of said base plate and said rear surface of said cover plate.

2. A security door lock as recited in claim 1 further comprising:

means for recoiling said intermediate portion of said cable into said chamber between said base plate and said cover plate when said intermediate portion of said cable is not being loop over a door knob.

3. A security door lock as recited in claim 1 wherein said base plate is made of steel.

4. A security door lock as recited in claim 1 wherein said base plate has a height H1 and H1 is in the range of 10–18 inches.

5. A security door lock as recited in claim 1 wherein said base plate has a width W1 and W1 is in the range of 2–4 inches.

6. A security door lock as recited in claim 1 wherein said base plate has a thickness T1 and T1 is in the range of 0.125–0.625 inches.

7. A security door lock as recited in claim 1 wherein D1 is in the range of 0.250 –0.750 inches.

8. A security door lock as recited in claim 1 wherein said spacer means are connected to said rear surface of said base plate.

9. A security door lock as recited in claim 8 wherein said spacer means are a plurality of spacer posts each having an aperture through which said means for securing said base plate to a doorway frame would be inserted.

10. A security door lock as recited in claim 9 wherein said means for securing said base plate to a doorway frame would be a plurality of lag bolts having a length of L1 and L1 is in the range of 1–4 inches.

11. A security door lock as recited in claim 1 further comprising vertically oriented groove means in said base plate and a pair of cable tensioning sliders installed in said groove means and said cable tensioning sliders slide reciprocally up and down therein.

12. A security door lock as recited in claim 11 wherein said cable tensioning sliders have a tracking groove along which said cable travels.

13. A security door lock as recited in claim 12 further comprising spring means for keeping said cable tensioning sliders spaced apart from each other.

14. A security door lock comprising:

a vertically oriented elongated base plate having a front surface, a rear surface, a left side, a right side, a top end and a bottom end;

means for securing said base plate to a doorway frame;

a cable having a first end, a second end and an intermediate portion;

means for securing said first and second ends of said cable to said base plate; said cable having a predetermined length L1;

a plurality of cable guide members extending outwardly from said front surface of said base plate;

a vertically oriented cover plate having a front surface, a mar surface, a left side wall, a right side wall, and an aperture formed in said left side wall through which said intermediate portion of said cable can be accessed and pulled outwardly therefrom so it can be looped over a door knob; and means for removably securing said cover plate to said base plate to form a chamber between said front surface of said base plate and said rear surface of said cover plate.

* * * * *